US005441469A

United States Patent [19]

Chern

[11] Patent Number: 5,441,469

[45] Date of Patent: Aug. 15, 1995

[54] EXERCISE MACHINE FOR REALISTIC SIMULATION OF BOAT ROWING

[76] Inventor: Minghwa Chern, 3Fl., No. 11, Alley 2, Lane 40, Sec. 3, Chungyang N. Rd., Peitou Dist., Taipei, Taiwan

[21] Appl. No.: 372,017

[22] Filed: Jan. 12, 1995

[51] Int. Cl.[6] ..... A63B 69/06

[52] U.S. Cl. ..... 482/72; 482/73

[58] Field of Search ..... 482/51, 72, 73, 142, 482/148, 55, 57

[56] References Cited

U.S. PATENT DOCUMENTS 335,597 2/1886 Libbey ..... 482/72

4,650,181 3/1987 Yang ..... 482/73

FOREIGN PATENT DOCUMENTS 0383830 11/1932 United Kingdom ..... 482/72

*Primary Examiner*—Stephen R. Crow

*Attorney, Agent, or Firm*—Hedman, Gibson & Costigan

[57] ABSTRACT

An exercise machine includes a bench defining an aperture, a seat slidably mounted on the bench, first and second columns on which the bench is mounted, a board defining a series of apertures, a bolt insertable through the aperture defined in the bench into one of the apertures defined in the board for retaining the board in position in respect to the bench, a third column on which the board is mounted, two rods transversely projecting from the board in opposite directions for supporting feet of an exerciser, two wings pivotably linked to the bench between a folded position and an extended position, two resistance devices each secured to a corresponding one of the wings, two oars each linked to a corresponding one of the resistance devices so that there will be resistance when the oars are rowed, two feet pivotably linked to the second column, two hydraulic cylinders each connected between the bench and a corresponding one of the feet so that the exercise machine is rockable.

6 Claims, 5 Drawing Sheets

EXERCISE MACHINE FOR REALISTIC SIMULATION OF BOAT ROWING

BACKGROUND OF THE INVENTION

This invention relates to an exercise machine and, more particularly, to an exercise machine for simulation of boat rowing.

There have been many exercise machines for simulation of boat rowing. However, conventional exercise machines for simulation of boat rowing include two major drawbacks. Firstly, they are bulky because they are not collapsible. Secondly, the motions of them are not realistic simulations of boat rowing as they are not susceptible to rocking. This invention is intended to provide an exercise machine for realistic simulation of the motion of boat rowing.

SUMMARY OF THE INVENTION

It is an objective of this invention to provide a collapsible exercise machine for simulation of boat rowing.

It is another objective of this invention to provide a rockable exercise machine for simulation of boat rowing.

DETAILED DESCRIPTION OF THE PREFERRED EMBODIMENT

In this specification, the term, oar, means a shaft in imitation of a shaft of an oar of a boat.

Figure 1:
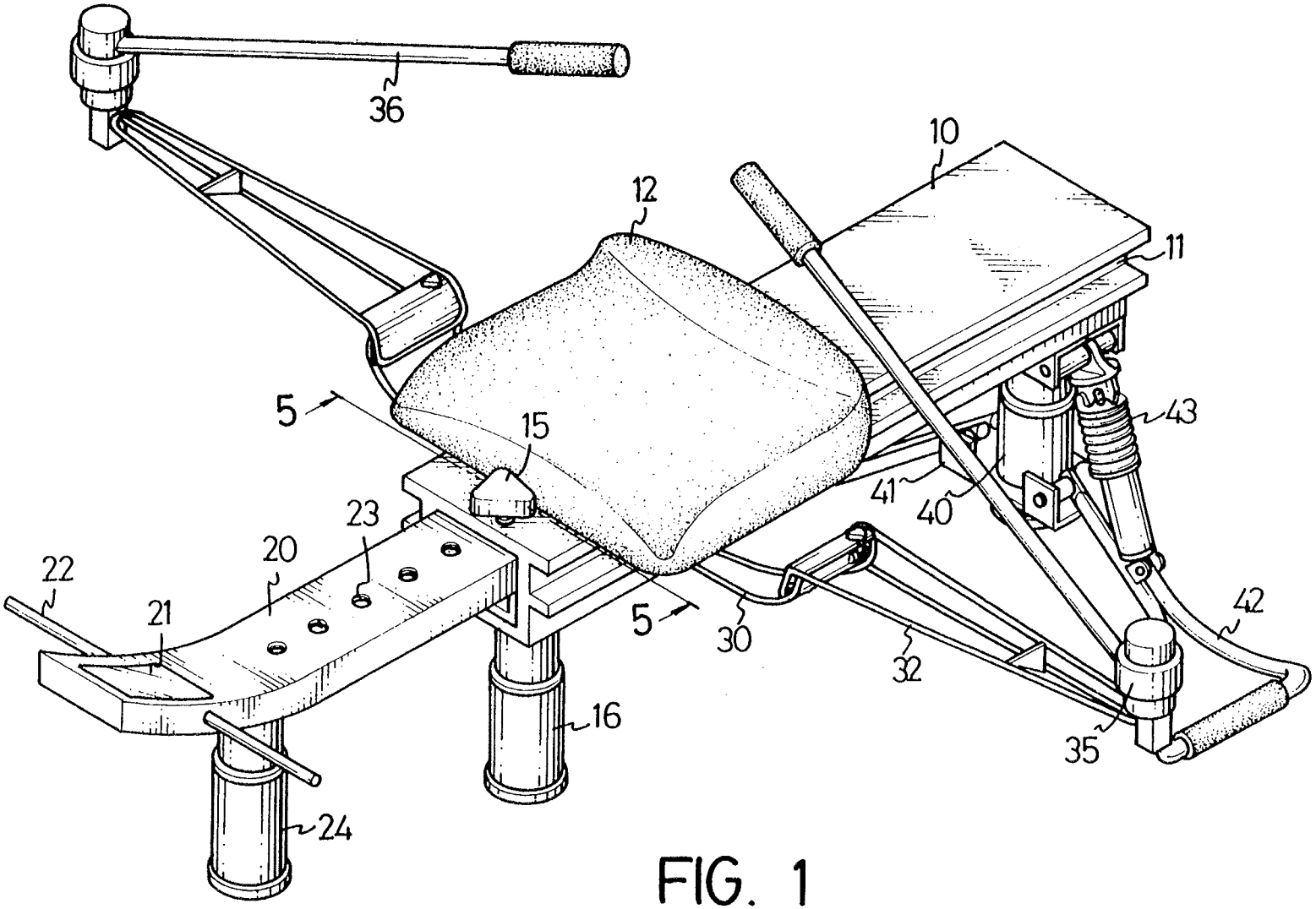
FIG. 1 is a perspective view of an exercise machine for simulation of boat rowing.

Referring to FIG. 1, the exercise machine includes a bench 10 includes two horizontal plates and two vertical plates, thus defining a longitudinal channel. Two horizontal fins (not numbered) project from each of the vertical plates of the bench 10. A groove 11 is defined between the fins projecting from each of the vertical plates of the bench 10.

Figure 2:
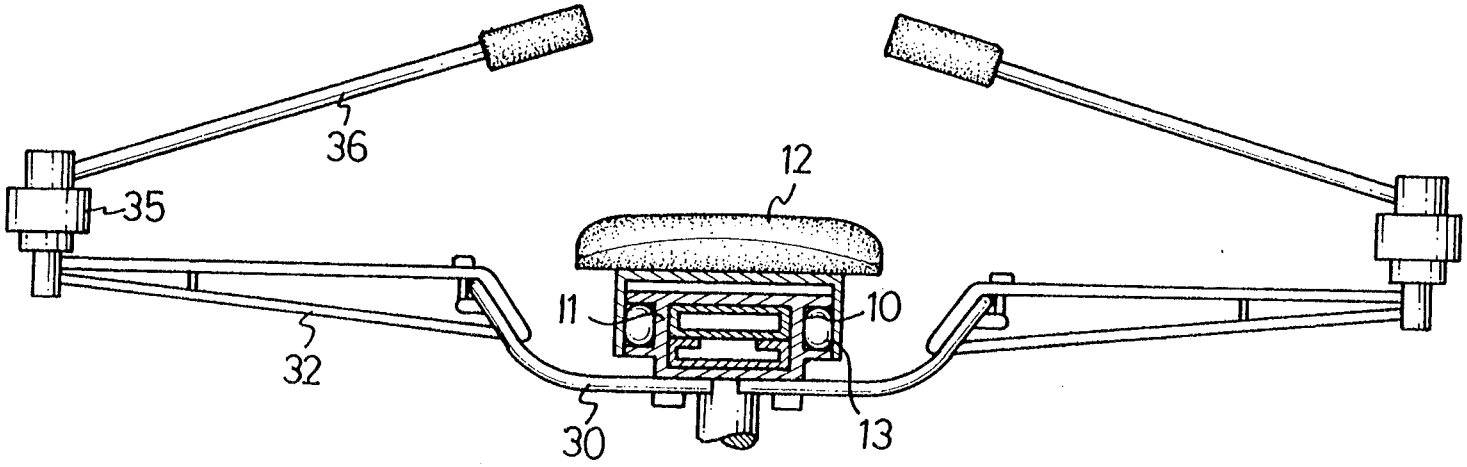
FIG. 2 is a rear view of a seat, a bench and two oars of the exercise machine as shown in FIG. 1.

Referring to FIG. 2, there is an inverted U-shaped bracket (not numbered) including a horizontal portion and two vertical portions. A seat 12 is mounted on the horizontal portion of the inverted U-shaped bracket. Each of two wheels 13 is mounted on a corresponding one of the vertical portions of the inverted U-shaped bracket such that the wheels 13 face each other. The inverted U-shaped bracket is mounted on the bench 10 so that each of the wheels 13 is slidable in a corresponding one of the grooves 11. Thus, the seat 12 is slidable on the bench 10.

Figure 5:
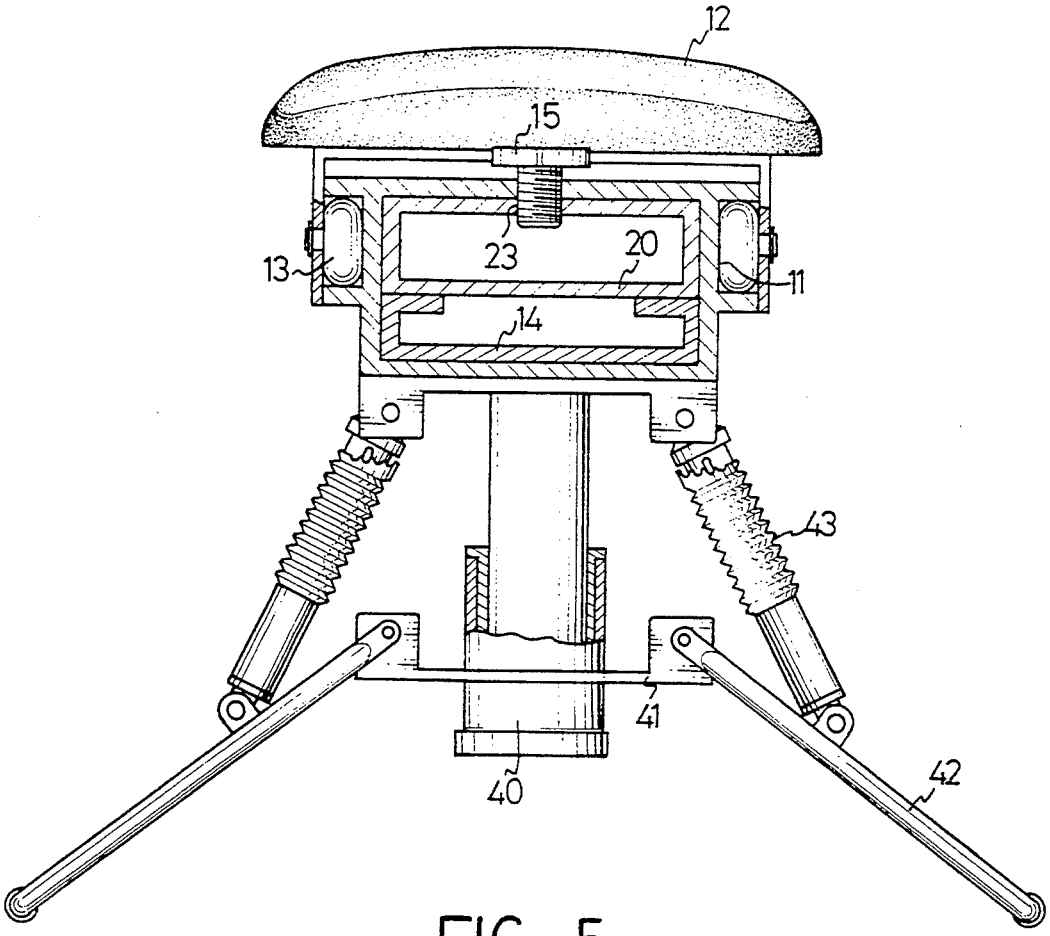
FIG. 5 is a cross-sectional view taken along a line 5—5 in FIG. 1.

Referring to FIGS. 1 and 5, a first column 16 and a second column 40 projects from a lower one of the horizontal plates of the bench 10 for supporting the bench 10. An aperture 17 is defined in upper one of the horizontal plates of the bench 10. A board 20 is retractable in the channel defined in the bench 10. The board 20 defines a number of apertures 23. A knob 15 is secured at a tip of a bolt 16. The bolt 16 is insertable through the aperture 17 into one of the apertures 23 for retaining the position of the board 20 relative to the bench 10. The bolt 16 is engageable with the board 20 by means of threading. The knob 15 is used for rotation of the bolt 16.

A meter, an electric watch or a monitor 21 is mounted on an end portion of the board 20 for providing some figures concerning the amount of exercise done or to be done by an exerciser who uses this exercise machine. The end portion of the board 20 is arched upwardly so that the monitor 21 is easily visible to the exerciser. A rod 22 projects from each of two lateral edges of the board 20. The feet of the exerciser can be located on the rods 22. A foot rest can be mounted on each of the rods 22. A third column 24 projects downwardly from the board 20 for supporting the board 20.

Referring to FIG. 1, two brackets 30 are attached to the lower horizontal plate of the bench 10.

Figure 3:
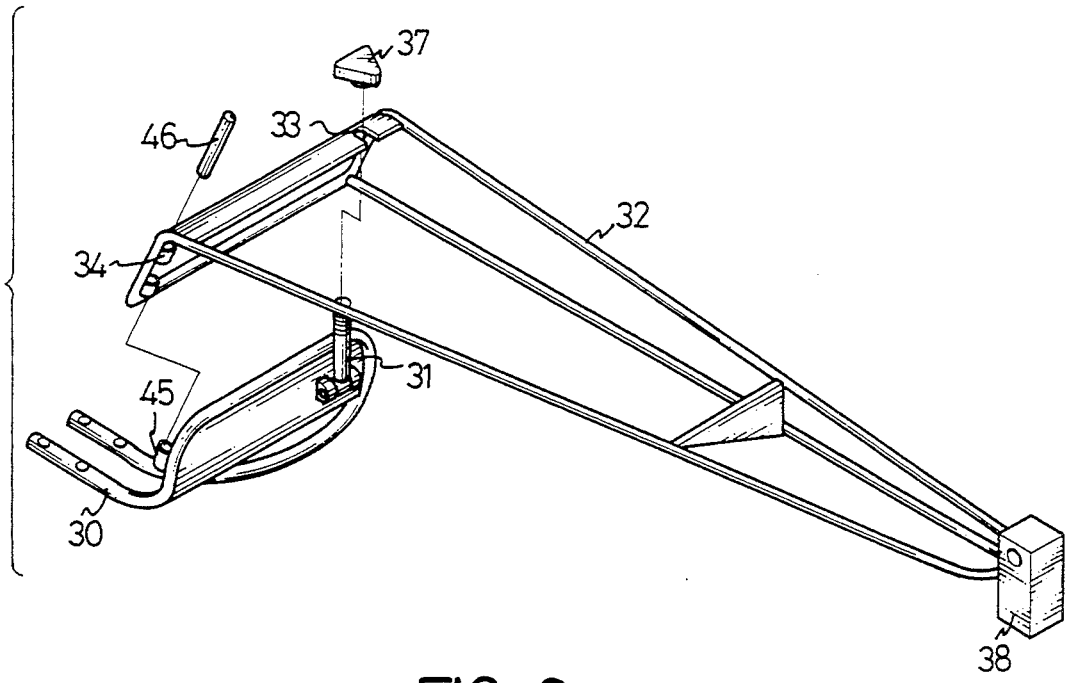
FIG. 3 is a perspective view of a foot of the exercise machine as shown in FIG. 1.
Figure 4:
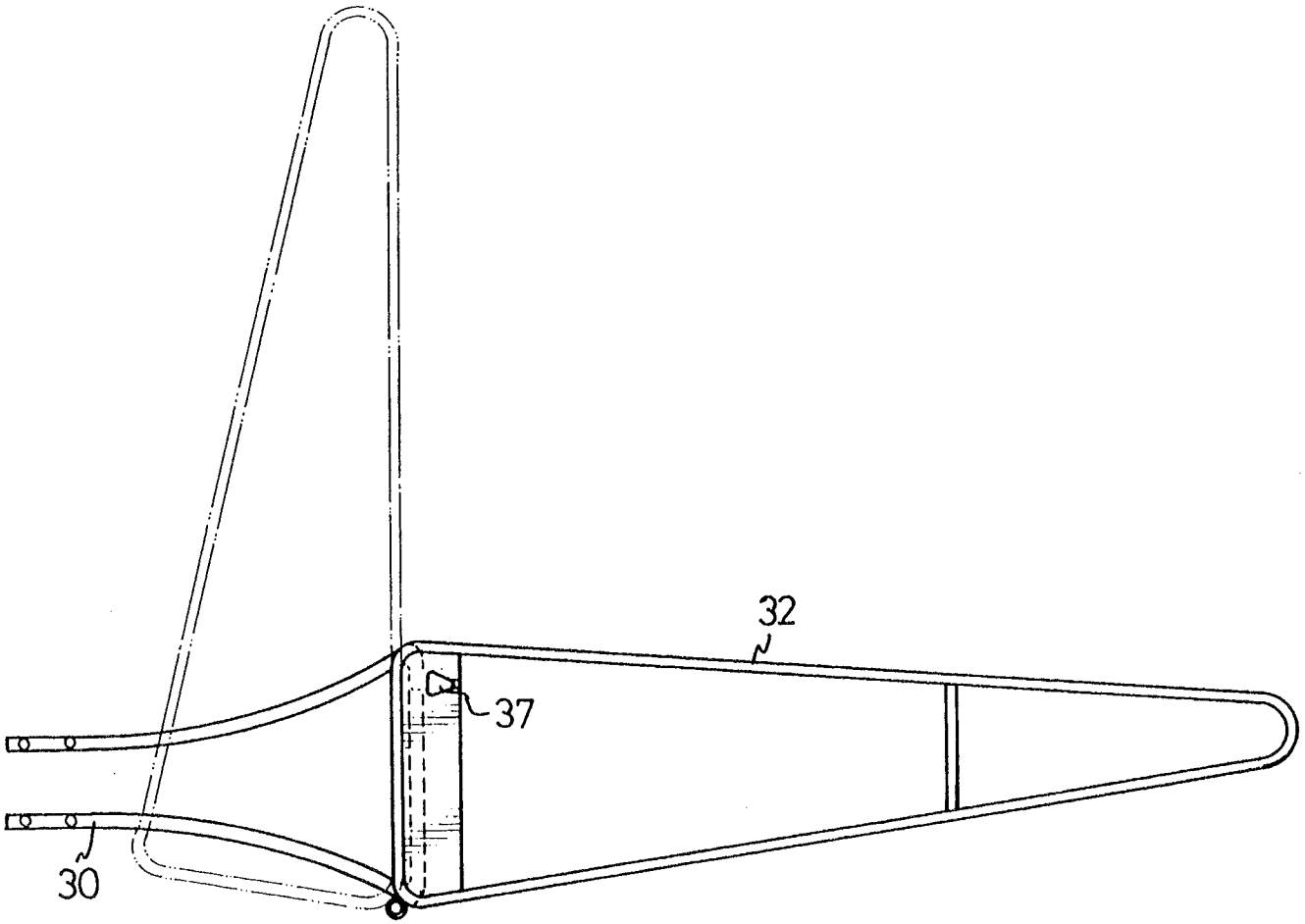
FIG. 4 is a top view of the foot as shown in FIG. 3.

Referring to FIG. 3, each of the brackets 30 includes a free end portion which is bent upwardly. Two separated sleeves 34 are secured to the free end portion of each of the brackets 30. A bolt 31 is pivotably mounted on the free end portion of each of the brackets 30. Each of two wings 32 includes a first end portion bent downwardly. A sleeve 45 is secured to the first end portion of each of the wings 32. Each sleeve 45 is disposed between a corresponding pair of sleeves 34. A pin 46 is inserted into each pair of sleeves 34 and a corresponding sleeve 45 so that each of the brackets 30 is pivotably connected with a corresponding one of two wings 32.

A cutout (not numbered) is defined in the first end portion of each of the wings 32. Each of the bolts 31 can be moved in one of the cutouts 33 when each of the wings 32 is moved to an extended position relative to a corresponding one of the brackets 30. Each of two knobs 37 is engageable with a corresponding one of the bolts 31 by means of threading for retaining each of the wings 32 in the extended position relative to a corresponding one of the brackets 30. Each of two feet 38 is welded to a second end portion of a corresponding one of the wings 32.

Each of two oars 36 is linked to a corresponding one of two resistance devices 35 secured to a corresponding one of the feet 38. An exerciser can exercises by rowing the oars 36. The resistance devices 35 will not be described in detail as they can be of any type including two rotatably connected portions so that there will be resistance when there is rotation between the portions thereof.

Referring to FIG. 5, a bracket 41 is secured to the second column 40. Each of two feet 42 includes a first end portion pivotably linked to the bracket 41 and a second end portion located on the ground. Each of two hydraulic cylinders 43 includes an upper tip pivotably linked to the bench 10 and a lower tip pivotably linked to a corresponding one of the feet 42. The exercise machine is rockable because of the feet 42 and the hydraulic cylinders 43. Thus, the exercise machine according to this invention feels more like a real boat than conventional exercise machines.

I claim:

1. An exercise machine comprising a bench having an aperture, a seat slidably mounted on the bench, first and second columns on which the bench is mounted, a board slidably received in said bench a series of apertures, a bolt insertable through the aperture defined in the bench into one of the apertures defined in the board for retaining the board with position in respect to the bench, a third column on which the board is mounted, two rods transversely projecting from the board in opposite directions for supporting the feet of an exerciser, two wings pivotably linked to the bench between a folded position and an extended position, two resistance devices each secured to a corresponding one of the wings, two oars each linked to a corresponding one of the resistance devices providing resistance when the oars are rowed, two feet pivotably linked to the second column, two hydraulic cylinders each connected between the bench and a corresponding one of the feet so that the exercise machine is rockable.

2. An exercise machine according to claim 1 wherein the bench includes two horizontal plates and two vertical plates formed together thus defining a longitudinal channel for receiving the board.

3. An exercise machine according to claim 1 including two wheels attached to the seat, wherein the bench includes two lateral sides from each of which two horizontal fins project thus defining a groove, so that each of the wheels is slidable in a corresponding one of the grooves.

4. An exercise machine according to claim 1 including two brackets attached to the bench so that each of the wings is pivotably linked to a corresponding one of the brackets.

5. An exercise machine according to claim 4 including a retainer for retaining the wings in the extended position.

6. An exercise machine according to claim 5 wherein the retainer includes a bolt attached to each of the brackets, a cutout defined in each of the wings and a knob for engagement with the bolt by thread means.

* * * * *